US007603271B2

(12) United States Patent
Kim

(10) Patent No.: US 7,603,271 B2
(45) Date of Patent: Oct. 13, 2009

(54) SPEECH CODING APPARATUS WITH PERCEPTUAL WEIGHTING AND METHOD THEREFOR

(75) Inventor: Chan-Woo Kim, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 570 days.

(21) Appl. No.: 11/299,900

(22) Filed: Dec. 13, 2005

(65) Prior Publication Data

US 2006/0149534 A1 Jul. 6, 2006

(30) Foreign Application Priority Data

Dec. 14, 2004 (KR) ..... 10-2004-0105777

(51) Int. Cl.
*G10L 11/04* (2006.01)

(52) U.S. Cl. ..... 704/207

(58) Field of Classification Search ..... 704/207
See application file for complete search history.

(56) References Cited

U.S. PATENT DOCUMENTS

| | | | | |
|---|---|---|---|---|
| 5,905,970 | A * | 5/1999 | Aoyagi | 704/220 |
| 5,933,801 | A | 8/1999 | Fink et al. | |
| 2005/0137863 | A1 * | 6/2005 | Jasiuk et al. | 704/222 |

FOREIGN PATENT DOCUMENTS

| | | | |
|---|---|---|---|
| CN | 1159044 | A | 9/1997 |
| EP | 0 852 375 | | 7/1998 |
| JP | 8-123494 | A | 5/1996 |
| JP | 11-242498 | A | 9/1999 |

(Continued)

OTHER PUBLICATIONS

Hermansky, Perceptual linear predictive (PLP) analysis of speech, Nov. 27, 1989, Speech Technology Laboratory, pp. 1738-1750.*

(Continued)

*Primary Examiner*—David R Hudspeth
*Assistant Examiner*—Jakieda R Jackson
(74) *Attorney, Agent, or Firm*—Birch, Stewart, Kolasch & Birch, LLP

(57) ABSTRACT

A speech coding apparatus including a perceptual linear prediction (plp) analysis buffer configured to output a pitch period with respect to an original input speech signal and to analyze the input speech signal using a plp process to output a plp coefficient, an excitation signal generator configured to generate and output an excitation signal, a pitch synthesis filter configured to synthesize the pitch period output from the plp analysis buffer and the excitation signal output from the excitation signal generator, a spectral envelop filter configured to apply the plp coefficient output from the plp analysis buffer to an output of the pitch synthesis filter to output a synthesized speech signal, an adder configured to subtract the synthesized signal output from the spectral envelope filter from the original input speech signal output from the plp analysis buffer and to output a difference signal, a perceptual weighting filter configured to calculate an error by providing a weight value corresponding to a consideration of a person's auditory effect to the difference signal output from the adder, and a minimum error calculator configured to discover an excitation signal having a minimum error corresponding to the error output from the perceptual weighting filter.

4 Claims, 4 Drawing Sheets

FOREIGN PATENT DOCUMENTS

| | | | |
|---|---|---|---|
| KR | 10-0496670 | B1 | 1/2006 |
| WO | WO-02/33692 | A1 | 4/2002 |

OTHER PUBLICATIONS

Bong-Keun Yoo, et al., "A study of Isolated Words Speech Recognition in a Running Automobile", pp. 381-384.

Koshida Kazuhito, et al., "CELP Speech Coding Based on Mel-Generalized Cepstral Analysis" CELP, vol. J81-A, No. 2,1998, pp. 252-260.

Gunawan Wira, et al., "PLP Coefficients Can Be Quantized at 400 BPS" Proc. of IEEE ICASSP2001, 2001, vol. 1, pp. 77-80.

* cited by examiner

SPEECH CODING APPARATUS WITH PERCEPTUAL WEIGHTING AND METHOD THEREFOR

This application claims priority to Korean Application No. 10-2004-010577 filed in Korea on Dec. 14, 2004, the entire contents of which is incorporated by reference in its entirety.

BACKGROUND OF THE INVENTION

1. Field of the Invention

The present invention relates to a speech coding method and apparatus that uses a perceptual linear prediction (PLP) and an analysis-by-synthesis method to code/decode speech data.

2. Description of the Related Art

Speech processing systems include communication systems in which speech data is processed and transmitted between different users, etc. Speech processing systems also include equipment such as a digital audio tape recorder in which speech data is processed and stored in the recorder. The speech data is compressed (coded) and decompressed (decoded) using a variety of methods.

Various speech coders have been designed for voice communication in the related art. In particular, a linear prediction analysis-by-synthesis (LPAS) coder based a linear prediction. (LP) method is used in digital communication systems. The analysis-by-synthesis process refers to extracting characteristic coefficients of speech from a speech signal and regenerating the speech from the extracted characteristic coefficients.

Further, the LPAS coder uses a technique based on a code excited linear prediction (CELP) process. For example, the ITU-T (International Telecommunication Union-Telecommunication Standardization Sector) has defined several CELP specifications such as the G.723.1, G.728, G.729, etc. Other organizations have designated various CELP specifications, and thus there are several available specifications.

The CELP uses a codebook including M-numbered (generally, M=1024) code vectors that are different from each other. Then, an index of a codeword corresponding to an optimum code vector having the least recognition error between an original sound and a synthesized sound is transmitted to another entity. The other entity also includes the same codebook, and using the transmitted index, regenerates the original signal. Thus, because the index is transmitted rather than the entire speech segment, the speech data is compressed.

The transmission speed of the CELP speech coder is generally in the range of 4~8kbps. Thus, it is difficult to quantize or code a time varying coefficient that is under 1 kbps. Further, a quantizing error of the coefficient causes degradation in the regenerated tone quality. Therefore, instead of using a scalar quantizer, a vector quantizer is used to code the coefficient at a low transmission speed. Accordingly, the quantizing error can be minimized thereby allowing for a more fine tone regeneration.

Further, because the entire codebook is searched for the best coefficient, an efficient codebook search algorithm is used for real-time processing. For example, a Vector Sum Excited Linear Prediction (VSELP) speech coder developed by Motorola uses a search algorithm including a schematic codebook formed by a linear combination of several numbers of basic vectors. This algorithm reduces a channel error in comparison with a typical CELP using a random number codebook. The VSELP method also reduces an amount of memory required for storing the codebook.

However, when the LPAS coder uses the related art analysis-by synthesis methods such as the CELP and the VSELP, a person's auditory effect or hearing is not considered when extracting a coefficient of an input speech signal. Rather, the analysis-by-synthesis method only considers the characteristics of speech when extracting a characteristic coefficient. Further, because the auditory effect of a person is only considered when calculating an error of the original signal, the recovered tone quality and a transmission rate is disadvantageously degraded.

SUMMARY OF THE INVENTION

Accordingly, one object of the present invention is to address the above noted and other problems.

Another object of the present invention is to provide a speech coding apparatus and a method that takes into consideration a person's auditory effect by using a perceptual linear prediction and an analysis-by-synthesis method.

To achieve these and other advantages and in accordance with the purpose of the present invention, as embodied and broadly described herein, the present invention provides a novel speech coding apparatus. The apparatus according to one aspect of the present invention includes a speech coding apparatus having a perceptual linear prediction (plp) analysis buffer configured to output a pitch period with respect to an original input speech signal and to analyze the input speech signal using a plp process to output a plp coefficient, an excitation signal generator configured to generate and output an excitation signal, a pitch synthesis filter configured to synthesize the pitch period output from the plp analysis buffer and the excitation signal output from the excitation signal generator, a spectral envelop filter configured to apply the plp coefficient output from the plp analysis buffer to an output of the pitch synthesis filter to output a synthesized speech signal, an adder configured to subtract the synthesized signal output from the spectral envelope filter from the original input speech signal output from the plp analysis buffer and to output a difference signal, a perceptual weighting filter configured to calculate an error by providing a weight value corresponding to a consideration of a person's auditory effect to the difference signal output from the adder, and a minimum error calculator configured to discover an excitation signal having a minimum error corresponding to the error output from the perceptual weighting filter. According to another aspect, the present invention provides a speech coding method including outputting a pitch period with respect to an original input speech signal and analyzing the input speech signal using a perceptual linear prediction (plp) process to output a plp coefficient, generating and outputting an excitation signal, synthesizing the output pitch period and the excitation signal and outputting a first synthesized signal, applying the output plp coefficient to the first synthesized signal to output a second synthesized signal, subtracting the second synthesized signal from the original input speech signal and outputting a difference signal, calculating an error by providing a weight value corresponding to a consideration of a person's auditory effect to the output difference signal, and discovering an excitation signal having a minimum error corresponding to the calculated error.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by illustration only, and thus are not limitative of the present invention, and wherein.

DETAILED DESCRIPTION OF THE PREFERRED EMBODIMENTS

Reference will now be made in detail to the preferred embodiments of the present invention, examples of which are illustrated in the accompanying drawings.

In the present invention, the auditory effect is considered by using a perceptual linear prediction (PLP) method, which improves the recovered tone quality and the transmission rate of the coding apparatus. In more detail, FIG. 1 illustrates the PLP method in accordance with one embodiment of the present invention.

Figure 1:
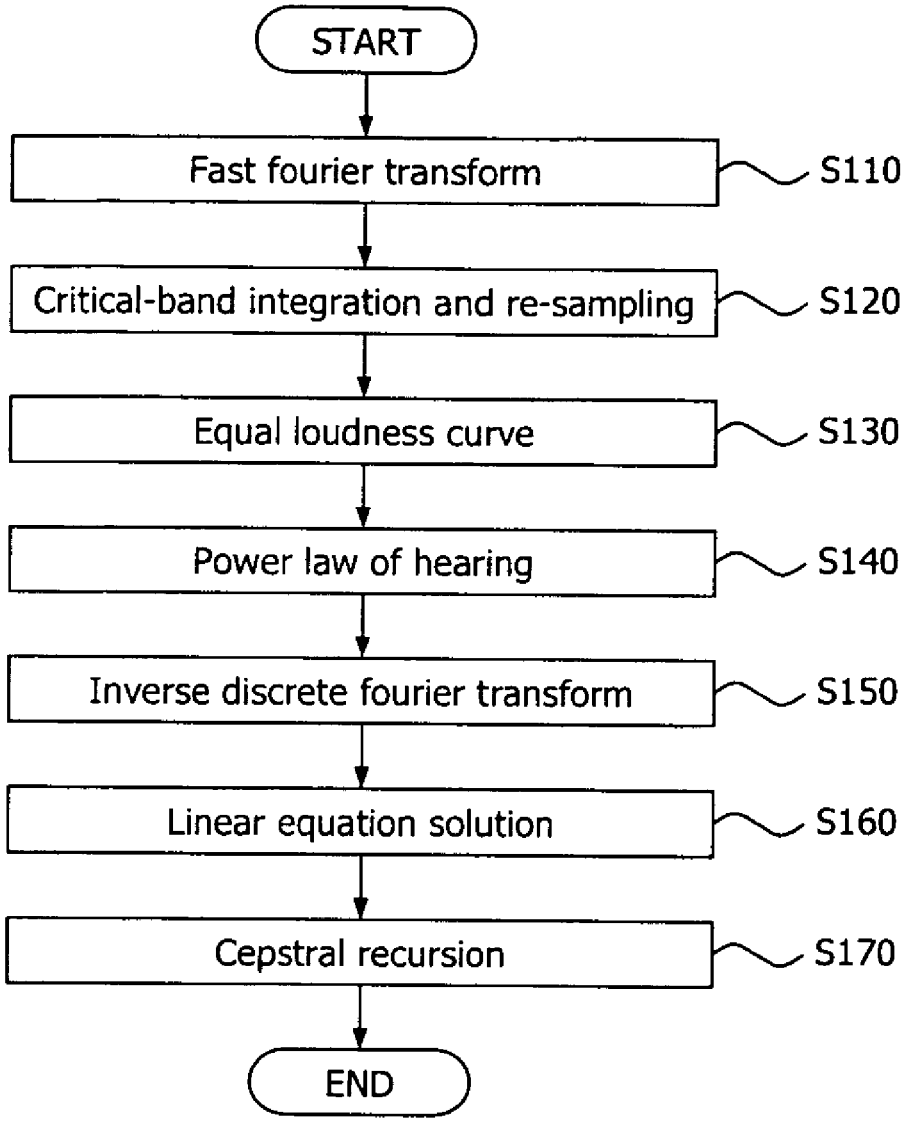
FIG. 1 is a flowchart showing a method for obtaining a perceptual linear prediction (PLP) coefficient in accordance with one embodiment of the present invention.

As shown in FIG. 1, a fast Fourier transform (FFT) process is performed on an input speech signal to thereby disperse the input signal (step S110). The FFT process is an algorithm used to increase the calculating speed efficiency by using the periodicity of the trigonometric function in calculating a dispersion fourier transform, which performs a calculation by simply dispersing the fourier transform. In other words, the fast fourier transform uses the term $_{\theta}^{(-\varphi 2\pi role/N)}$(k=0~N−1), which is produced when the dispersion Fourier transform is not completely performed, and omits a calculation for a term having the same value to a term pre-calculated by using the periodicity, thereby reducing the amount of required calculations.

After completing the fast fourier transform process, a critical-band integration and re-sampling process is performed (step S120). This process is used for applying a person's recognition effect based on a frequency band of a signal to the dispersed signal. In more detail, the critical-band integration process transforms a power spectrum of the input speech signal from a hertz frequency domain into a bark frequency domain using a bark scale, for example. The bark scale is defined by the following equation:

$$\Omega(\omega) = 6\ln\left\{\frac{\omega}{1200\pi} + \left[\left(\frac{\omega}{1200\pi}\right)^2 + 1\right]^{0.5}\right\}$$

Figure 2:
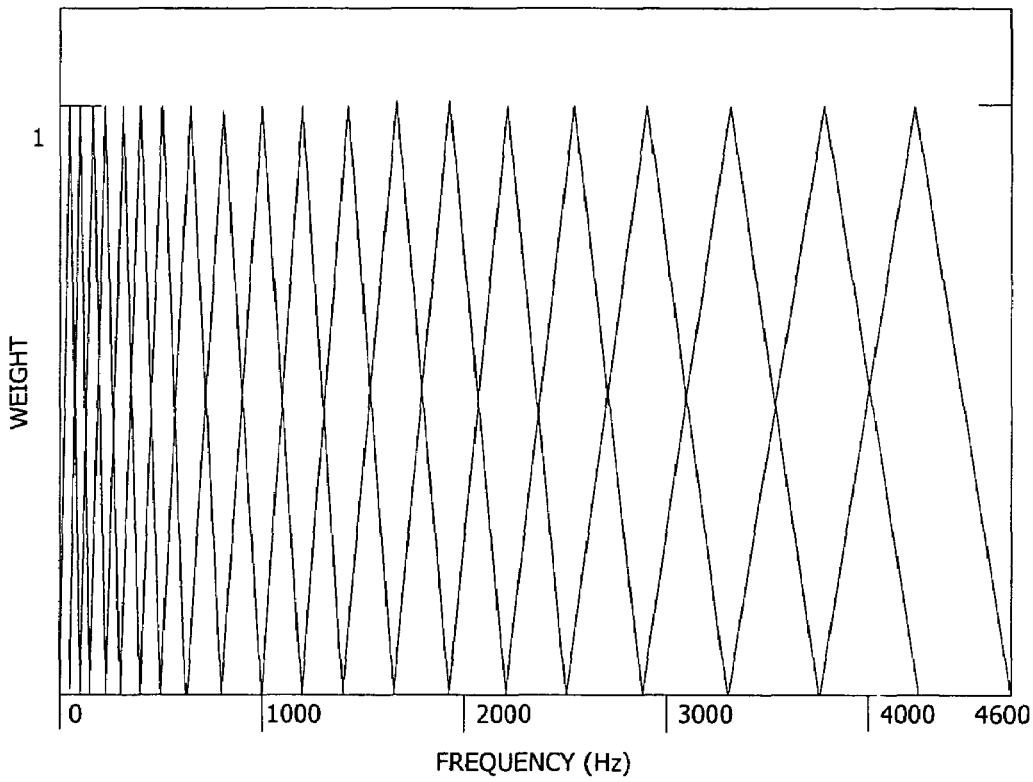
FIG. 2 is a diagram showing a frequency bandwidth verses a sampling rate according to a channel using a tree-structured non-uniform sub-band filter bank.

Further, the filter bank used for the critical-band integration process is preferably a tree-structured non-uniform sub-band filter bank for completely recovering an original signal. In more detail, FIG. 2 is a diagram showing a shape of a frequency band in which a sampling rate is split differently according to a channel using a tree-structured non-uniform sub-band filter bank. As shown in FIG. 2, the lower frequency domain where a person can hear or recognize sounds is split more finely than a high frequency domain where a person does not recognize or hear sounds. Further, the lower frequency domain is sampled to thereby consider the auditory characteristics of a person. According to the critical-band integration and re-sampling, a signal can be obtained, for which a frequency variation for the low frequency is emphasized and the frequency variation for the high frequency is reduced.

Then, as shown in FIG. 1, an equal loudness curve is multiplied by a frequency element which has passed through the critical-band integration and re-sampling process (step S130). The equal loudness curve is a curve showing a relation between a frequency and a sound pressure level of a pure tone heard in the same volume. That is, depending on an auditory characteristic on how a person estimates a volume of a sound in each frequency bandwidth, the equal loudness curve illustrates a reaction of the person's hearing with respect to an overall audio frequency bandwidth of 20 Hz to 20,000 Hz. The equal loudness curve is referred to as a Flecture & Munson curve.

Further, after the equal loudness curve has been applied, a "power law of hearing" process is applied (step S140). The power law of hearing process mathematically describes the fact that a person's auditory sense is sensitive to a sound which is getting louder but is tolerant to a loud sound which is getting far louder. The process is obtained by multiplying an absolute value of a frequency element by the square of one third.

After the above processes are performed, an inverse discrete fourier transform (IDFT) process is performed with respect to a signal to which a person's auditory characteristic is reflected. That is, a weight indicating the person's auditory characteristic is reflected to transform a frequency domain signal back into the time domain signal (step S150). After the IDFT process, a linear equation solution is obtained (step S160). Here, a durbin recursion process used in a linear prediction coefficient analysis can be used to solve the linear equation. The durbin recursion process uses less operations than other processes.

Next in step S170, a cepstral recursion process is performed on the solution of the linear equation to thereby to obtain a cepstral coefficient. The cepstral recursion process is used to obtain a spectrally smoothed filter, and thus is more advantageous than using the linear prediction coefficient process.

In addition, one type of the obtained cepstral coefficient is referred to as a PLP feature. Also, because modeling was performed during the process for obtaining the PLP feature in consideration of various auditory effects of people, a considerably higher recognition rate is achieved using the PLP feature in speech recognition.

Figure 3:
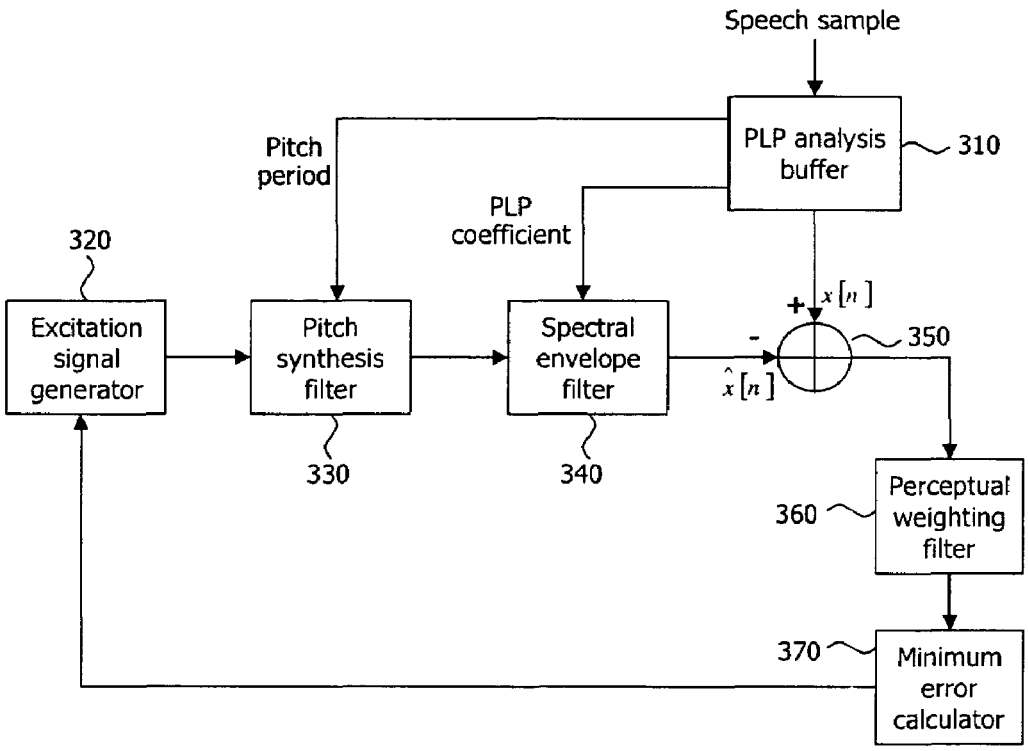
FIG. 3 is a block diagram of a speech coding apparatus in accordance with one embodiment of the present invention.

Turning now to FIG. 3, which is a block diagram of a speech coding apparatus in accordance with one embodiment of the present invention. As shown in FIG. 3, the speech coding apparatus includes a PLP analysis buffer 310 for buffering and outputting an input speech sample, outputting a pitch period for the input speech sample, and PLP-analyzing the input speech sample to output a PLP coefficient. Also include is an excitation signal generator 320 for generating and outputting an excitation signal; a pitch synthesis filter 330 for synthesizing the pitch period output from the PLP analysis buffer 310 and the excitation signal output from the excitation signal generator 320, and for outputting a pitch synthesized signal; and a spectral envelope filter 340 for outputting a synthesized speech signal by applying the PLP coefficient output from the PLP analysis buffer 310 to the pitch synthesized signal output from the pitch synthesis filter 330.

Further included is an adder 350 for subtracting the synthesized speech signal output from the spectral envelope filter 340 from the original speech signal input from the PLP analysis buffer 310; a perceptual weighting filter 360 for providing a weight in consideration of a person's auditory effect to the difference between the original signal and the synthesized signal thereby to calculate an error characteristic of the signal; and a minimum error calculator 370 for determining an excitation signal having a minimum error. Further, the PLP analysis in the PLP analysis buffer 310 is performed using the procedure shown in FIG. 1.

In addition, the excitation signal generator 320 includes an inner parameter such as a codebook index and a codebook gain of the codebook. Further, the excitation signal having the minimum error calculated in the minimum error calculator 370 is searched from the codebook. Also, when transmitting a signal, the speech coding apparatus 300 transmits the pitch period, PLP coefficient, codebook index and codebook gain corresponding the excitation signal having the minimum error.

Figure 4:
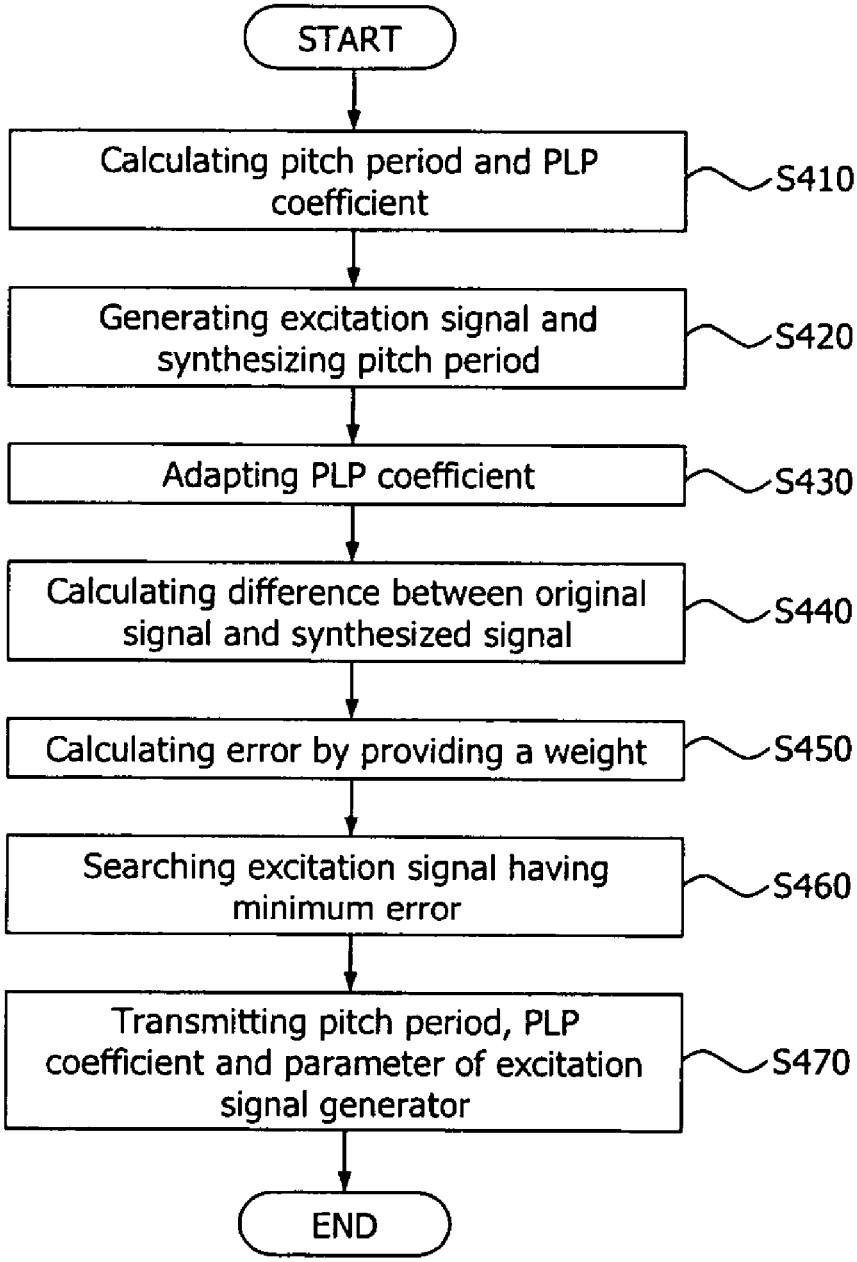
FIG. 4 is a flowchart showing a speech coding method in accordance with one embodiment of the present invention.

Turning next to FIG. 4, which is a flowchart showing a speech coding method in accordance with one embodiment of the present invention. As shown in FIG. 4, the pitch period and the PLP coefficient are obtained from a speech sample of an original speech signal (step S410). The PLP coefficient can be obtained using the procedure shown in FIG. 1.

The excitation signal is then generated and synthesized with the pitch period (step S420). Next, the PLP coefficient is applied to the signal obtained by synthesizing the excitation signal and the pitch period, thereby outputting a synthesized speech signal (step S430). Further, the excitation signal corresponds to a sound source generated by a person's lung before it passes through a vocal tract of a person. At this time, by re-applying the PLP coefficient thereto, the person's auditory effect is reflected considering the effect of the vocal tract, so the synthesized signal is similar to the original speech signal.

Thereafter, the synthesized speech signal is subtracted from the original speech signal (step S440). Note that even though the synthesized signal is similar to the original speech signal, because the synthesized signal is artificially made, there may be a difference between the synthesized signal and the original speech signal. By considering the difference therebetween, a precise speech signal that is hardly different from the original speech signal can be transmitted.

In addition, an error is calculated by multiplying a weight value in consideration of a person's auditory effect to the difference between the original signal and the synthesized signal (step S450). Note, the error is not calculated simply with respect to a frequency or volume of the signal but is calculated using the weight value considering the auditory effect, thereby producing a voice that is directly heard.

Afterwards, the excitation signal having the minimum error is discovered (step 460). Next, the pitch period, the PLP coefficient, the codebook index and the codebook gain of the excitation signal having the minimum error are transmitted (step S470). Here, the speech is not transmitted but rather the codebook index, the codebook gain, the pitch period and the PLP coefficient are transmitted so as to reduce an amount of transmission data.

As stated so far, according to the speech coding apparatus and method of the present invention, the auditory effect of a person is applied to the procedures of extracting a parameter and calculating an error so as to improve an overall tone quality. Also, the perceptual linear prediction (PLP) method used in the present invention describes an overall spectrum of a speech using a lower coefficient than the linear prediction (LP) method so as to lower a bitrate of data transmission.

Further, it is also possible to apply the above methods to a CODEC (coder/decoder). In this instance a receiver, namely, a decoder receives the pitch period, the PLP coefficient, the codebook index and the codebook gain of the excitation signal having the minimum error transmitted from the coder. Thereafter, the decoder generates the excitation signal suitable for the received codebook index and the codebook gain to synthesize the pitch period. Then, the PLP coefficient is applied thereto so as to recover the original speech signal.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A speech coding apparatus, comprising:

a perceptual linear prediction (plp) analysis buffer configured to output a pitch period with respect to an original input speech signal and to analyze the input speech signal using a plp process to output a plp coefficient;

an excitation signal generator configured to generate and output an excitation signal;

a pitch synthesis filter configured to synthesize the pitch period output from the plp analysis buffer and the excitation signal output from the excitation signal generator;

a spectral envelop filter configured to apply the plp coefficient output from the plp analysis buffer to an output of the pitch synthesis filter so as to output a synthesized speech signal;

an adder configured to subtract the synthesized signal output from the spectral envelope filter from the original input speech signal output from the plp analysis buffer and to output a difference signal;

a perceptual weighting filter configured to calculate an error by providing a weight value corresponding to a consideration of a person's auditory effect to the difference signal output from the adder; and a minimum error calculator configured to discover an excitation signal having a minimum error corresponding to the error output from the perceptual weighting filter, wherein the excitation signal generator includes a codebook index and a codebook gain of a codebook, and said apparatus further comprises a searching unit configured to search the excitation signal having the minimum error from the codebook, the apparatus further comprising a transmitter configured to transmit the codebook index, the codebook gain, the pitch period and the plp coefficient to an intended user.

2. The apparatus of claim 1, further comprising:

a fast Fourier transform unit configured to disperse the original input speech signal;

a critical-band integration and re-sampling unit configured to apply a person's recognition effect based on a frequency band to the dispersed signal;

a multiplier configured to multiply a frequency element passed through the critical-band integration and re-sampling unit by an equal loudness curve;

a power law of hearing unit configured to apply the person's recognition effect according to a variation of volume of sound to the equal loudness curve applied signal and to output the applied signal;

an inverse discrete Fourier transform unit configured to obtain a linear equation in a time domain of the signal output from the power law of hearing unit; and a cepstral coefficient unit configured to solve the linear equation and apply the solved result to a cepstral recursion process so as to obtain a cepstral coefficient.

3. A speech coding method, the method comprising:

outputting a pitch period with respect to an original input speech signal and analyzing the input speech signal using a perceptual linear prediction (plp) process to output a plp coefficient;

generating and outputting an excitation signal;

synthesizing the output pitch period and the excitation signal and outputting a first synthesized signal;

applying the output plp coefficient to the first synthesized signal to output a second synthesized signal;

subtracting the second synthesized signal from the original input speech signal and outputting a difference signal;

calculating an error by providing a weight value corresponding to a consideration of a person's auditory effect to the output difference signal;

discovering an excitation signal having a minimum error corresponding to the calculated error;

searching for the excitation signal having the minimum error from a codebook, wherein the codebook includes a codebook index and a codebook gain of a codebook; and transmitting the codebook index, the codebook gain, the pitch period and the plp coefficient to an intended user.

4. The method of claim 3, wherein obtaining the plp coefficient comprises:

dispersing the input speech signal using a fast Fourier transform;

applying a person's recognition effect based on a frequency band to the dispersed signal using a critical-band integration and re-sampling process;

multiplying a frequency element passed through the critical-band integration and re-sampling process by an equal loudness curve;

applying the person's recognition effect according to a variation of volume of sound to the equal loudness curve applied signal using a power of law of hearing process and outputting the applied signal;

obtaining a linear equation in a time domain of the output applied signal using an inverse discrete Fourier transform; and solving the linear equation and applying the solved result to a cepstral recursion process so as to obtain a cepstral coefficient.

* * * * *